United States Patent [19]

Belbel et al.

[11] Patent Number: 4,816,792

[45] Date of Patent: Mar. 28, 1989

[54] CIRCUIT BREAKER APPARATUS WITH REMOTE CONTROLLED OPENING AND CLOSING OF ITS CIRCUITS

[75] Inventors: Elie Belbel, Epinay Sur Seine; Christian Blanchard, Nanterre; André Haury, Le Raincy; Michel Lauraire, Courbevoie, all of France

[73] Assignee: La Telemecanique Electrique, France

[21] Appl. No.: 97,357

[22] Filed: Sep. 8, 1987

Related U.S. Application Data

[63] Continuation of Ser. No. 798,667, Nov. 15, 1985, abandoned.

[30] Foreign Application Priority Data

Nov. 16, 1984 [FR] France ..... 84 17506

[51] Int. Cl.[4] ..... H01H 73/00; H01H 77/00

[52] U.S. Cl. ..... 335/14; 335/6; 335/20

[58] Field of Search ..... 335/6, 14, 16, 20, 35

[56] References Cited

U.S. PATENT DOCUMENTS

| | | | |
|---|---|---|---|
| 2,685,011 | 7/1954 | Boller et al. | 335/35 |
| 3,469,216 | 9/1969 | Shiraishi | 335/16 |
| 3,622,923 | 11/1971 | Shaffer | 335/17 |
| 4,262,270 | 4/1981 | Takeda et al. | 335/140 X |
| 4,539,538 | 9/1985 | Flick et al. | 335/16 |
| 4,540,961 | 9/1985 | Maier | 335/195 X |
| 4,598,263 | 7/1986 | Heyne et al. | 335/20 X |
| 4,608,546 | 8/1986 | Westermeyer | 335/20 |
| 4,625,190 | 11/1986 | Wafer et al. | 335/20 |

*Primary Examiner*—H. Broome

*Attorney, Agent, or Firm*—William A. Drucker

[57] ABSTRACT

A circuit breaking apparatus with remote controlled opening and closing of its circuits is provided in which the supports of the fixed and mobile contacts are adapted so as to develop repulsion forces which produce an excellent limitation of the short circuit currents because no parasite mass is connected to the mobile contact despite the presence of an electromagnet which must actuate it through a pusher or a slide.

11 Claims, 5 Drawing Sheets

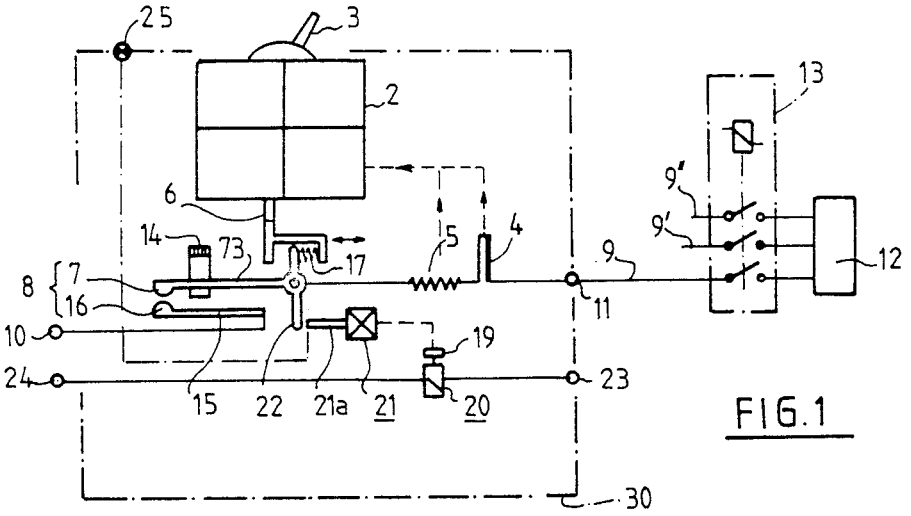
FIG. 1
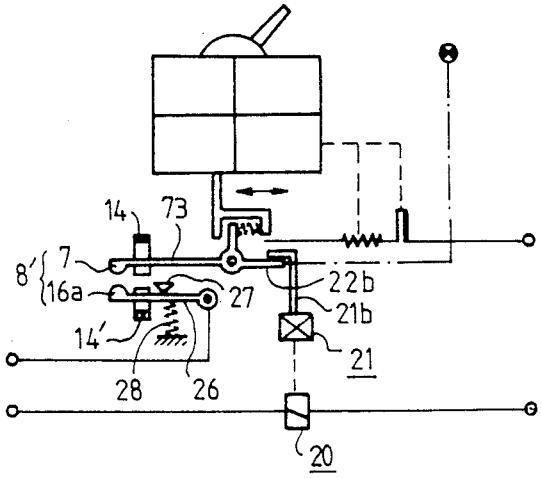
FIG. 2
FIG. 3
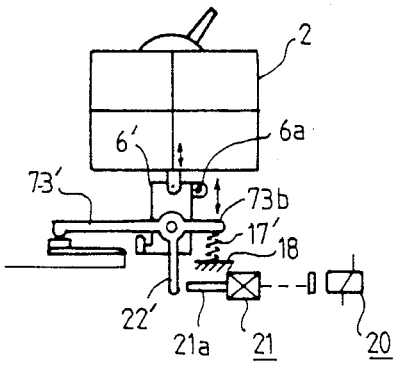
FIG. 4
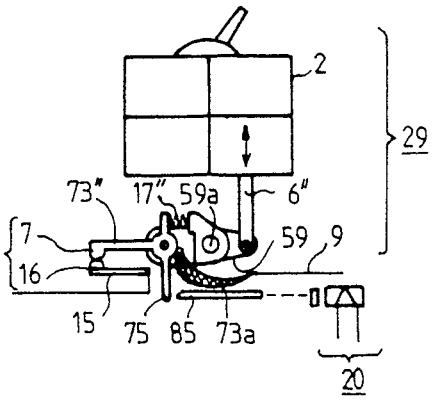

CIRCUIT BREAKER APPARATUS WITH REMOTE CONTROLLED OPENING AND CLOSING OF ITS CIRCUITS

This application is a continuation,
of application Ser. No. 798,667, filed Nov. 15, 1985, now abandoned.

BACKGROUND OF THE INVENTION

1. Field of the Invention

The invention relates to a circuit breaker apparatus, more especially a multiphase circuit breaker comprising a common quick trip mechanism which may be set and tripped by means of a local manual control member, a multiplicity of power circuits each comprising between two terminals a switch which is placed in an arc extinction chamber and whose mobile contact is connected to said mechanism so as to be closed or opened thereby, detectors which react to over currents of different kinds in these circuits by causing said mechanism to trip and, consequently, the automatic opening of the switches, and an electromagnet which is associated with the apparatus for causing remote controlled opening of the mobile contacts of the switches not involving the tripping of said mechanism.

2. Description of the Prior Art

Such apparatus are used in electric installations where it is desired both to protect the lines as well as the loads which are associated therewith, and to further have the faculty of interrupting the supply of these loads by means of a remote control, and by a channel separate from the one which comprises contactors usually placed between the apparatus and a corresponding load; it is also possible to interrupt the supply of a group of machines fed by this apparatus, without for all that being forced to de-energize the corresponding contactors and so to cause the combination of their states to disappear, which then allows an immediate start up to be effected under the same conditions.

An apparatus is already known, for example from the patent application PCT No. WO 83/02680, whose general construction is to be found in the one mentioned above, for answering the needs of users when the nominal currents which flow therethrough are less than a hundred amperes or so.

When the nominal currents exceed this level and when consequently the mass of the contact pieces as well as the presumed currents of the short circuits increase correspondingly, the limitation devices using coils placed in series in the circuit for attracting a plunger core which strikes the mobile contact, become inefficient.

Recourse is then had to apparatus in which considerable energy is accumulated in powerful springs of a quick trip mechanism, which is set for example by means of a local control member and which is then released by the action of the over current detectors placed in series when high over currents appear.

When such over currents reach the thresholds of the excessive currents observed when outright short circuits occur, it is moreover necessary to limit their peak by providing a very rapid opening of the switch which therefore only calls into play the smallest possible masses and which essentially uses the electro-dynamic repulsion forces which are communicated without any delay to the conductors when these latter have a particular geometry; the effect of these forces may be improved in a way known per se by the cooperation of magnetizable masses placed in the vicinity.

In the known apparatus which has just been mentioned, small sized torsion springs apply their nominal torque without any multiplication to a piece carrying the mobile contact, so as to confirm mechanically, and so with a certain delay, the open position which the mobile contact takes with a certain delay; this is itself imputable on the one hand to the dynamic response time which acts on the movement of a magnetic striker and, on the other hand, to the very nature of the magnetic phenomena which govern its attraction; these phenomena which are more especially due to saturation confer then a limit on the efficiency of the currents, whereas that of the electrodynamic repulsion phenomena increases substantially as the square root of these currents, all other things being equal.

In addition, in this known apparatus, the manual opening and closing effected by the local control member are operated at slow speed because the torsion springs whose presence was mentioned above only come into play during the automatic opening procedure; this drawback which appears because of the use of a direct kinematic connection between the local manual control member becomes a defect when the nominal currents exceed a certain value.

To these disadvantages, which only appear with the increase of the nominal current, must be added those which result from a permanent connection of the armature of the electromagnet not only with the support of the mobile contact of the switch but also with the operating member; such an arrangement which causes a more rapid wear of the parts of the mechanism and in fact forces the operator to exert a greater force on the manual control member, has the drawback that remote operated closure of the switch cannot be prevented by the operator unless he permanently maintains his action on said control member.

Moreover if, with such a permanent connection, it is necessary either to actuate switches whose nominal current is high by means of a force accumulating mechanism or to simultaneously set this mechanism by a channel parallel to that which should actuate the switches, it would be necessary to give this electromagnet dimensions larger than those which are strictly indispensable for separating a mobile contact from a fixed contact; apart from the exaggerated character of the dimensions which this electromagnet might require, it will be noted that the trend of the attraction curve of an electromagnet is not compatible with the curve of the resistant forces presented by the travel of a small volume force accumulating mechanism, in which the initial forces to be provided are much greater than those which exist at the end of this travel.

SUMMARY OF THE INVENTION

The invention consequently provides a circuit breaker apparatus whose opening may be remotely controlled without it being necessary to cause all or part of a force accumulating mechanism to operate whose function is either to automatically operate rapid opening of the switch, or to establish a closure and opening of this switch by means of a manual local control member, said apparatus being in addition able to effect manual or remote controlled opening in an independent way by means of an electromagnet whose size is the smallest possible; it is clear that the reduced size measurement should not be understood here as a given geometrical dimension, nor as a relative space requirement, but as the necessary size which an electromagnet must have for carrying out the work strictly indispensable to the actuation of one (or several) power switches whose modes of operation and properties take into consideration the break or establishment of the nominal current.

In accordance with the invention, this aim is reached because the mobile contact and the fixed contact comprise supports which are placed in parallel relation facing each other so that, and which are applied one against the other by a resilient contact pressure member, whose resilience is chosen so that, on the one hand, a considerable automatic movement of at least the mobile contact support is provided by the electro-dynamic forces when short circuit currents appear and so that, on the other hand, a controlled movement more reduced than the automatic movement is provided by the remote control electromagnet during its change of state.

Other complementary measures, adapted for reducing the mass of the moving parts and so for better limiting the short circuit currents, as well as other arrangements adapted for improving the insulation, for economizing the remote control energy, will be made to the main arrangement mentioned above.

In variants of construction adapted for facilitating mounting, for giving to the arc chambers associated with the switch a volume compatible with their function and to confer on the apparatus a flexibility of use corresponding to the different needs of users, the electromagnet is disposed in a region, respectively a removable sub assembly, which does not encroach on the volumes which are usually reserved for the arc chamber, for the quick trip mechanism, respectively the current detectors.

BRIEF DESCRIPTION OF THE DRAWINGS

The invention will be better understood from reading the following description with reference to the accompanying drawings in which:

FIG. 1 shows schematically a first apparatus in accordance with the invention, in which the repulsion only concerns a contact lever;

FIG. 2 shows schematically a variant of construction of the invention, in which the repulsion concerns the supports of the fixed and mobile contacts;

FIG. 3 shows one embodiment in which the mobile contact lever is not carried by the body of the apparatus but by a rocking part;

FIG. 4 shows one embodiment in which the mobile contact lever is urged by a spring moving at the same time as the rocking part;

DESCRIPTION OF THE PREFERRED EMBODIMENTS

A remote controlled circuit breaker apparatus 1a such as shown in FIG. 1 comprises an energy accumulating mechanism 2 which may be set and released by means of local manually actuated control member 3.

Figure 8:
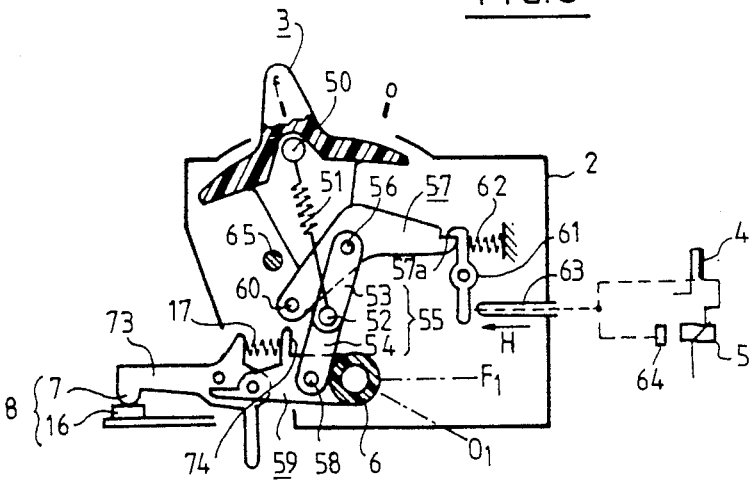
FIG. 8 illustrates in a simplified way a non limitative example of a quick trip force accumulating mechanism with manual reset.

This mechanism, one embodiment of which is shown in FIG. 8 as a non limitative example, may be tripped by one or more over current detectors, for example by the bimetal strip 4 or by the magnetic coil or turn 5 and, in this case, it may be engaged and set by means of the control member 3.

This mechanism has a transmission piece 6 with rectilinear or rotary movement which is adapted to move piece 73 supporting the mobile contact 7 of a switch 8 placed in series in the circuit 9 between two power terminals 10, 11.

This circuit 9, as well as other identical circuits 9', 9'' if the apparatus is multiphase, serves for supplying a load 12, generally through a contactor apparatus 13 placed in series.

Preferably, and if the presumed short circuit current over intensities justify it, a magnetizable mass 14, such as a U shaped piece, is placed in the vicinity of the mobile piece represented for example by a lever carrying the mobile contact insert, for improving the efficiency of the repulsion forces which, by developing between this piece and a substantially parallel conducting piece 15, carrying the fixed contact 16, tend to raise piece 73 while compressing a contact pressure spring 17; this compression may reach a considerable value because of the appreciable movement which the repulsion forces may communicate to lever 73 while limiting said short circuit currents.

The circuit 9 of the apparatus may therefore be closed by member 3 manually and be opened either manually by the same member, or automatically by the action of the detectors 4, 5 or by the effect of the repulsion forces alone or in combination with the magnetic effect of piece 14.

When mechanism 2 is in the set state, in order to cause remote opening of this switch 8 when it is closed, and reclosure after it has been opened, an armature 19 of an electromagnet 20 acts in one of its two possible states on a unidirectional coupling device 21 which transmits movement by the action of a pusher **21*a* at a point or extension 22 of lever 73. The movement effected in this case by this lever is only a fraction K of the preceding movement and only causes partial compression of the spring 17**. This latter is therefore designed so as to have the resilience required for the first repulsion movement and the bearing force necessary for establishing a good pressure of the contacts.

The coupling is unidirectional to the extent that it causes lever 73 to be raised if the switch is closed and none of its important parts is driven by the lever when this latter is moved by other channels 6, 14.

It is clear that, instead of a thrust exerted by a pusher, a slide could be used exerting a tractive force as will be seen in another embodiment.

Two remote control terminals 23, 24 provide the power supply for the coil of the electromagnet, and a signalling means 25 on the front face indicates to the user placed in the vicinity of the apparatus if such a remote control order is followed or not by effect, so as to inform him of the state of circuit 9; in this apparatus, the local control member 3 may in fact be in a position corresponding to the set state and thus let it be assumed that the switch is closed, whereas a remote controlled opening order is communicated thereto by another way.

The apparatus 1b of FIG. 2, where the parts having the same functions bear the same reference numbers, only differs from the preceding one by the fact that the fixed contact support of switch 8' is itself formed by a pivoting lever 26 finding, against an insulating stop 27, a rest position which is conferred thereon by a return spring 28; in this case, when repulsion forces possibly accentuated by the presence of a magnetic piece 14' appear, the two levers 7 and 26 move apart simultaneously, so that the fixed contact becomes in this case a retractable fixed or pseudo fixed contact 16*a;* a tractive piece or slide 21*b* acting on the extension 22*b* is here used for providing remote controlled opening of the switch, but a pusher could also be suitable.

In a particular embodiment of the mobile contact shown in FIG. 3, where the missing parts are to be found in the preceding Figures, the mobile contact lever 73' is carried by a piece 6' connected to a mechanism 2 and pivoting at 6*a* in the body, whereas an arm 73i b of this lever bears on a contact pressure spring 17' placed between it and body 18; it can be seen that the operation is the same as above.

In another embodiment shown in FIG. 4, the transmission piece 6'' is connected to a rocking contact support 59 which is mounted for pivoting at 59*a* in the body and which carries the mobile contact lever 73'' connected to line 9 through a flexible conductor 73*a*; the mobile contact 7 is applied against the fixed contact 16 by a spring 17'' which is placed between the lever 73'' and its support 59; a pusher 85 forming part of the unidirectional coupling cooperates with the extension 75.

Figure 5:
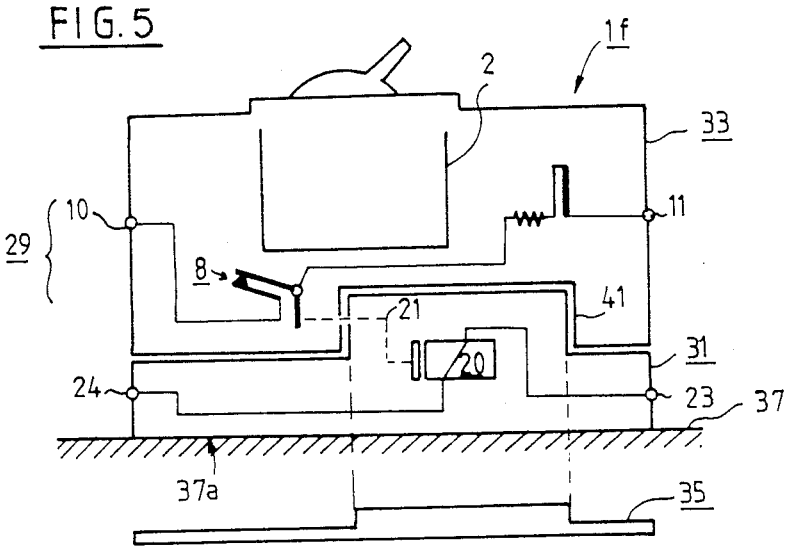
FIG. 5 illustrates schematically a particular embodiment of the invention according to FIGS. 1 to 4.

The apparatus 1a to 1d which, in the preceding Figures, comprise for example a general case 30, may be constructed in accordance with constructional methods one of the principles of which, shown in FIG. 5, provides for the association of a removable remote control case 31, containing at least one electromagnet such as 20, with a body 33, containing the essential parts of the circuit breaker 29.

This latter body 33 may thus be used either alone, and it is then necessary to associate therewith an insulating cover 35 for closing a cavity 41 of the body in which the switch and the electromagnet cooperate, or in combination with a remote control case 31 when such a method of construction is desirable; depending on the complexity or simplicity of the unidirectional coupling device, this latter may be incorporated as a whole or partly in case 31 or, on the contrary, form part of the body 33.

In FIG. 5, the base 37*a* of the remote control case 31 or an apparatus 1*f*, respectively the cover 35 if this is used, are placed against a fixing plate 37 and are situated between this latter and the body 33 of the circuit breaker 29.

Figure 6:
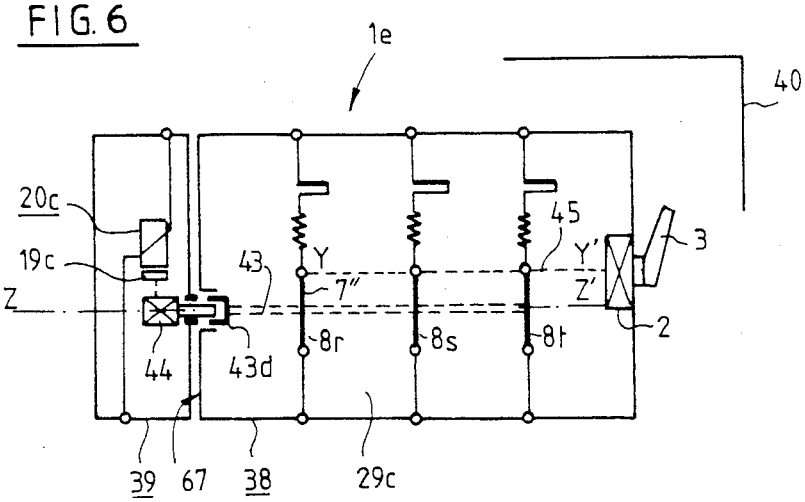
FIG. 6 shows schematically a second particular embodiment of the invention preferably according to FIGS. 4 or 2.
Figure 7:
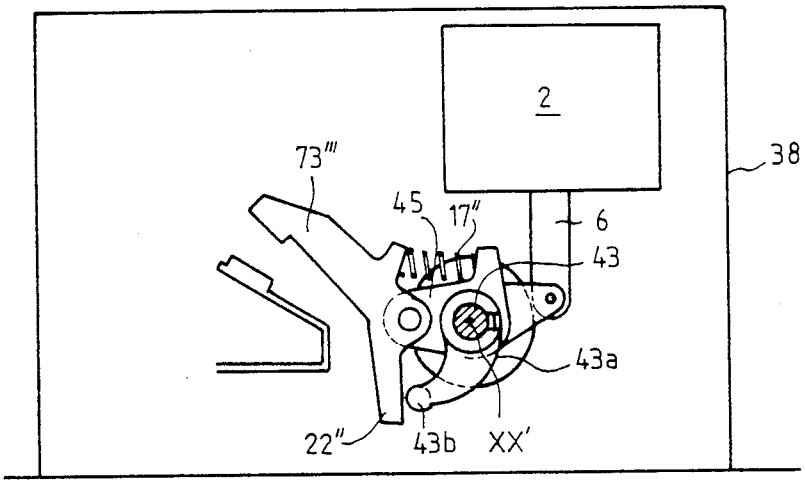
FIG. 7 shows in a section perpendicular to the axis YY' an interesting embodiment of a part of the apparatus of FIG. 6.

In FIG. 6, where the apparatus 1*e* may preferably comprise one of the switches such as those described in FIGS. 4 or 3, the body 38 of the circuit breaker 29*c* and the case 39 of the remote control device are placed side by side; the same wall or plate 40 may serve for supporting the body and the case, or else only support the body, the case then being fixed laterally on this latter against the lateral wall 67. This type of mounting which lends itself well to the use of a common rotary transmission member 43 for transmitting the movement delivered by the unidirectional coupling 44 and the electromagnet 20*c*,19*c* through the end 43*d*, becomes even more advantageous if the axis of this transmission means 43 is coaxial with the pivoting axis of insulating parts 45 supporting the mobile contact levers 7'' of the switches such as 8*r*, 8*s*, 8*t*, as can be seen in FIG. 7, where part 43 is a cylindrical rod which is integral with rotary pushers 43*a* whose ends 43*b* act on extensions 22'' of contact levers 73'''; the supports of levers 45 are themselves pivotably mounted on this rod and are connected to the transmission piece 6.

If required, when the remote control device is not used, a lateral cover may close off the region of the body 38 where the connection with the remote control case 39 is provided.

In all the embodiments shown, it can be seen that the only expenditure of energy which the electromagnet must supply results from a limited compression of the contact pressure springs 17; the size of this electromagnet may therefore be relatively reduced with respect to that which would be required for actuating the switches using means disposed in the mechanism 2 and so provided and dimensioned for carrying out other functions.

When it is desired to promote the effects of the repulsion on the mobile levers 7 of the switches, it is necessary to give the contact pressure springs 17 a great elasticity, which nevertheless delivers the contact pressure required for normal operation of the switch when this latter has passing therethrough currents going from the nominal current to about ten times this current.

Such elasticity is favorable to the extent that it confers an appreciable travel on this mobile contact of each switch, when it is urged by the repulsion forces, whereas the variation of the resistant force opposed to the armature remains small when this travel distance is smaller, as the case occurs for remote controlled opening of this switch and in the absence of faults. A small sized control electromagnet may therefore be used.

Purely by way of illustration, a general diagram of a quick trip mechanism 2 is shown in FIG. 8 which may be used in the invention.

The local manual control member 3 oscillates about a pivot (which is masked in the Figure) so as to move a point 50 between positions 0 and F, corresponding to opening and closing of the switch by the manual channel.

This point 50 is connected by a traction spring 51 to the pivot point 52, common to two links 53, 54 which form a toggle joint 55 and one of which bears on the point 56 of a tripping lever 57, whereas the other is connected by an articulation 58 to a transmission lever 59, representing for example part 59 of FIG. 4 or the mobile contact support 45 of FIG. 7, so as to communicate thereto an angular movement. The tripping lever 57 which is pivotably mounted at point 60 is retained by a latch 61 whose holding position is provided by a spring 62; this latch may be moved in direction H by a transmission means 63 receiving directly or indirectly the movements of the bimetal strips 4 or those of the plates or magnetic cores 64 associated with the coils or turns 5.

When it is desired to open the switch manually, the rocking of the control member 3 towards -0- places the point 50 in a position in which the force of spring 51 may first of all move the articulation 52 laterally then cause very rapidly contraction of the toggle joint, so that the transmission lever 59 which is in position $F_1$ is moved towards the top of the Figure into position -$0_1$-; reverse movements are effected when the control member pivots from 0 towards F.

If the over current detection means 4, 5 move latch 61 which compressing the spring 62, the tripping lever 57 loses its fulcrum point 57a and swings to the top of the FIG. 8 while bringing point 56 sharply into a position in which the angle formed by points 56, 52, 58 changes direction, so that the force of spring 51 is now exerted with a lateral component which also causes the toggle joint to contract very rapidly, and thus causes the transmission lever to pivot automatically upwardly as before; a stop 65 serves for defining the limit position of the tripping lever 57.

The new arrangement of articulation 52 with respect to the pivot (not visible) of the control member 3 then brings this latter into the position -0-.

A further engagement of lever 57 under latch 61 will be provided by member 3 through means not shown, which drive the lever 57 in a clockwise direction as far as this latch, when this latter passes from the position -0- to the position -F-.

Figure 9:
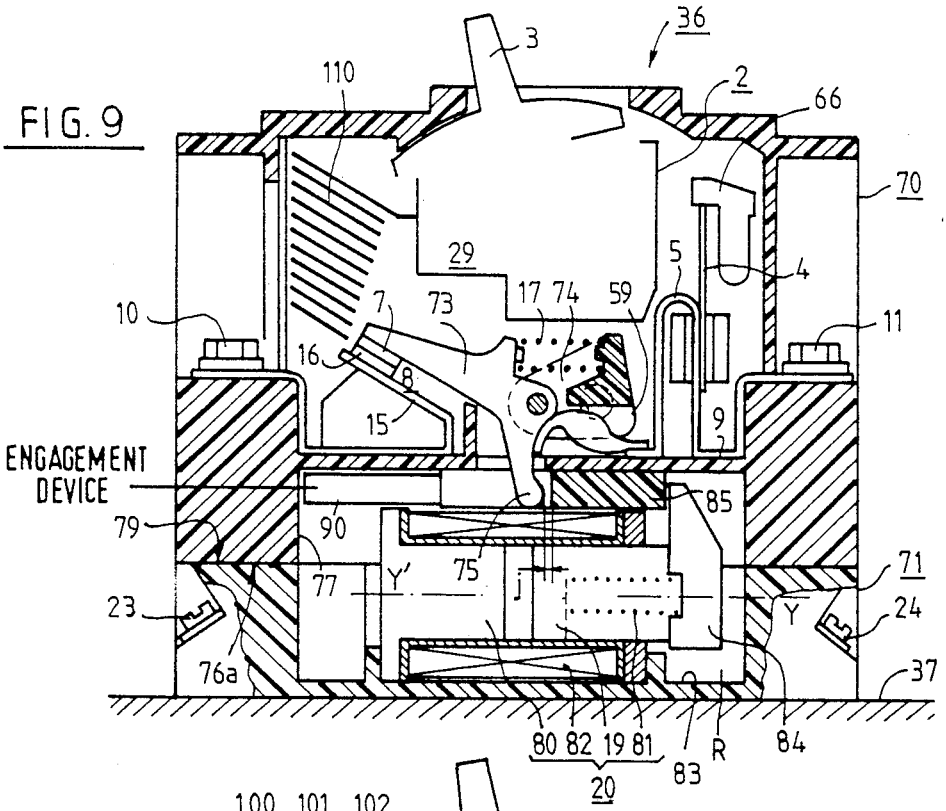
FIGS. 9 and 10 show in two sections and in elevation an apparatus according to the invention which uses directly the principle of FIG. 4.

An electric protection apparatus 36, shown in FIG. 9 and using the means illustrated in FIG. 1, comprises an insulating envelope or body 70 in which is disposed a circuit breaker apparatus 29 and an insulating remote control case 71, in which is essentially disposed an electromagnet 20.

The envelope and the case are mechanically associated together, and this latter is in contact with a plate or board 37 on which the apparatus may be fixed.

The electric members of the circuit breaker comprise for each phase line a pair of input and output terminals 10, 11 and an electric circuit 9, comprising in series:

a switch 8 having a fixed contact 16 and a mobile contact 7 carried by a lever 73, a first current detector 5 which may be of an electromagnetic type having a single spire or a coil which is responsive to the instantaneous current over intensities, whose size does not yet reach that of short circuit currents, and a second current detector 4 using for example a bimetal strip for reacting to smaller over currents which have on the other hand a longer duration.

These two current detectors which are intended essentially for protecting a load placed in series with the apparatus (for example a motor) must then cause opening of the switch. Such opening, which is automatic, is obtained by the release of a latch 61 of the quick trip mechanism 2, one possible construction of which has been illustrated in FIG. 8.

This quick trip mechanism is shown in FIG. 9 in the set state, in which the mobile contact lever 73 receives from a lug 74 of the oscillating contact support 59 a torque which is transmitted resiliently by the compression spring 17 and which applies the mobile contact 7 on the fixed contact 16 for closing switch 8.

This switch may be opened manually, by placing the control member 3 in position 0 or automatically when an action of appropriate direction is applied to latch 61 by piece 66. These two methods of opening switch 8 have a character of rapidity which is due for example to the instantaneous contraction of the toggle joint 55 under the effect of spring 51.

In the invention, the mobile contact support 59 has an arm or extension 75 which is directed towards a face of application **76*a* of the envelope 70, and which penetrates into a cavity 77 thereof. Preferably, this arm will not have the current of circuit 9 passing therethrough so as not to increase the mass of lever 73, the current then passing through a braided wire 73a whose end moves slightly. This cavity may be closed by a sealed and insulating cover such as 35, see FIG. 5, when the application face 76*a* of the envelope is not applied against the bearing face 79 of the case 71**, and when the circuit breaker is used without an additional remote control device.

It will be noted that the formation of this cavity does not form properly speaking a deliberate and artificial increase of the volume of the circuit breaker to the extent that constructional measures are being developped at the present time for giving to the cases of circuit breakers dimensions, wall thicknesses and stiffening means allowing them to resist high internal pressures which are developed by the automatic opening operations on the appearance of a short circuit.

Figure 10:
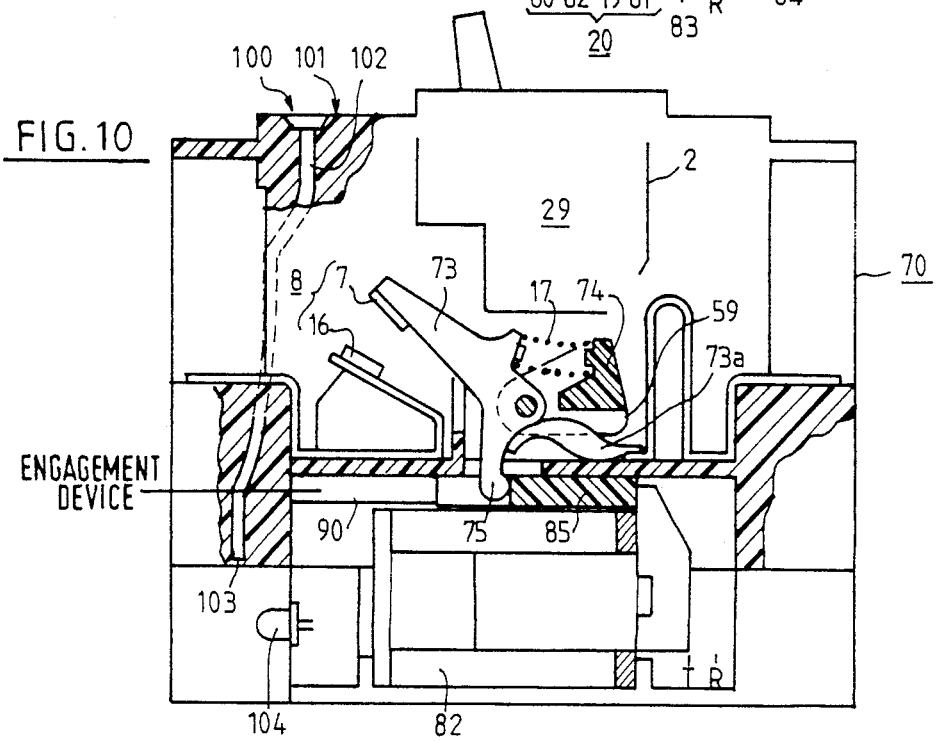

When a remote control case 71 is associated therewith, cavity 7 receives here at least a part of the elements placed in this case; in the non limitative embodiment shown in FIG. 9, see also FIG. 10, the electromagnet 20 comprises a fixed yoke 80, a mobile armature or plunger core 19 which may be attracted by the yoke, one or more return springs 81 giving to this armature a rest position situated to the right of FIG. 9, an energization coil 82 and connection terminals such as 23, 24 for providing the power supply of the coil. The elements of the electromagnet 20 are placed in a housing 83 in case 71 which joins, completes and closes the cavity 77 when the faces **76*a* and 79** are sealingly associated.

The mobile armature 19 which moves along an axis YY', preferably parallel to the faces **76*a*, 79 and the wall 37 is connected to a shoulder 84 actuating a pusher 85 which transmits its movement to the arm 75**.

In a preferred embodiment, this transmission is provided by means of an insulating piece or pusher 85, movable in parallel relation to axis YY' which is separated from the arm 75 by a slight clearance "j" when the switch is closed, and when the armature 19 is at rest "R", and which bears on this arm while compressing spring 17 for opening of the switch 8, when, this latter having been previously closed, the armature 19 takes up a work position "T" under the effect of the energization of coil 82, see FIG. 10. If the switch is already in the open position when such energization occurs, the movement of the armature does not necessarily produce a direct effect on this arm.

It can therefore be seen that remote controlled opening of switch 8 may be effected without it being necessary to release the mechanism 2, which has the advantage on the one hand of not being forced to send an operator on the spot to actuate the control member 3 and on the other of not causing useless wear of its parts.

When the circuit breaker device 29 comprises, as is shown in FIGS. 9, 10, a fixed contact conductor 15 extending parallel to the contact lever 73, the electrodynamic forces which are developed during the flow of short circuit currents are increased and cause this contact lever to be repelled in a clockwise direction producing automatic opening of great amplitude which is rapid enough to provide limitation of these currents.

Such instantaneous opening, which may occur because of the measured flexibility which spring 17 presents before the mechanism 2 is tripped and which may be confirmed either by a device engaging with lever 73 (not shown), or by subsequent tripping of the mechanism 2 (effected by the detector 5), should not be slowed down either by the existence of a connection with the insulating piece 85 nor by the presence of useless mobiles masses. This piece or pusher 85 is therefore designed so as to only exert a thrust on arm 75 when coil 82 is energized. The presence of this spring with measured flexibility is furthermore one of the arrangements required so that opening of switch 8 by electromagnet 20 takes place without appreciable expenditure of energy, and over an angular travel distance sufficient for a remote controlled opening of the circuit to be provided in insulating conditions which are as good as possible.

Figure 11:
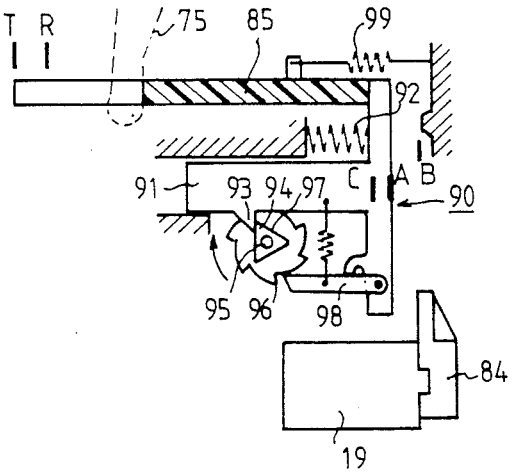
FIG. 11 shows a mechanical engagement device for remotely and economically opening and closing the circuits of the apparatus of the invention using short current pulses.

In an advantageous embodiment of the opening device remote controlled by an electromagnet, this latter receives current pulses of short duration and a mechanical engagement device such as 90 is associated with the insulating piece 85 for maintaining this latter is a work position "T" corresponding to that which it reached during the attraction of the plate in the position "T" and so as to give it a rest position corresponding to that of the armature at rest when another current impulse has been applied; such an engagement device which is illustrated in a non limitative way in FIG. 11, and which maintains piece 85 alternately in the positions shown in FIGS. 9, respectively 10, is comparable in operation to those met with in push button switches with latching engagement.

In one embodiment illustrated by way of example, a slide 91 of the engagement device 90 moves between an abutment position B which is provided by the spring 92 and an end position C which is provided by the leftward movement of armature 19; a hook 93 on this slide bears on a top 94 of cam 95 when this latter is in the position shown so as to provide for the slide an engagement position A. This cam, which is integral with a toothed wheel 96, presents alternately to the hook an apex or a flat (97) whenever the pawl 98 fixed to the slide pushes one of the teeth back so that when a flat lets the hook pass leftwards in the Figure, the slide finds again its position B.

The insulating piece 85 which bears on the slide through the action of the return spring 99, assumes then alternately a rest position R, respectively a work position T, in which the mobile contact of the switch 8 is alternately closed or opened when a short current pulse has passed through the coil.

Figure 13:
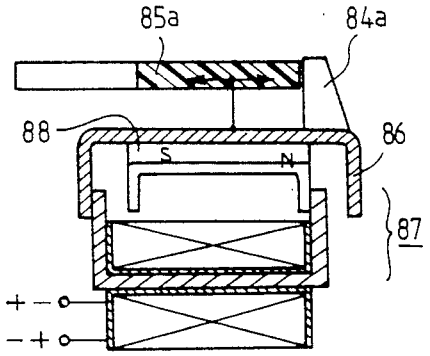
FIG. 13 shows in a simplified way a type of polarized electromagnet which may be used for remote controlled opening and closing without a permanent current expenditure.

Another way of producing movement and holding in position of the insulating piece without requiring a permanent expenditure of current consists in using a bistable electromagnet 87 with permanent magnet 88, known for example from the French Pat. No. 2 358 006, see FIG. 13; in this latter case, it is not necessary to associate, with the armature 86 of such an electromagnet 87, a return spring or engagement device 90 for defining the rest position, it may on the contrary be necessary to use one for returning the pusher 85*a*, associated with the armature against the insulating piece 84*a*, see FIG. 13.

It is advantageous, when the circuit breaker apparatus is of the multiphase type, to use a common insulating piece such as 85 for acting simultaneously on each of the contacts associated with the different phase circuits. In this case, care must be taken so that the force communicated to this piece by the armature of the electromagnet is exerted at a point which provides the best balance with respect to the distribution and orientation of the resistant forces.

Appropriate longitudinal guide means in parallel relation to YY', but not shown, are also used so that the movements of the insulating piece take place without risk of jamming.

In all cases, where it is desired to make the circuit breaker device 29 independent, the mobile members and parts associated with the electromagnet, as well as this latter, must be permanently installed on and respectively in case 71, respectively 31; because of the existence of a pusher or slide connection, the association with the remote control case is made without difficulties.

The interest and advantages of the invention are in no wise related in a limitative way to the internal construction of the circuit breaker apparatus, to the extent that this latter corresponds to the operation which was defined in the preamble.

The arrangements made for example in FIG. 9 for causing the extension of the arcs in a finned chamber 110 are not limitative either, if it is considered that better results may be obtained by causing the rapid introduction of an insulating screen between the fixed and mobile contacts at the moment where they have just moved apart.

It is also clear that the circuit breaker apparatus instead of comprising a single break switch, could comprise a mobile contact bridge or have in series in each phase circuit two separate switches having separate circuit breaking respectively current limiting functions.

In an advantageous arrangement shown in FIG. 10 and intended to inform the user of the state of the circuits of the apparatus, signalling means 100 will be disposed visibly on the front face 101 of the case for retransmitting optically or mechanically an indication of the effective position of the insulating piece or respectively of that of the mobile contact lever; the circuits 9 may in fact be opened by the electromagnet 20 whereas the position of the manual member 3 is in a position corresponding normally to a closed condition, which is likely to mislead the maintenance staff. Such an optical signalling means may advantageously use a light emitting diode placed in series with the coil 82 and in parallel with Zener diodes which stabilize its voltage, if the armature of the electromagnet is held in a working position by the permanent passage of a current; light transmission may be provided by means of an optical fiber 102 which is integral with body 70 and one end of which 103 comes opposite the diode 104, situated in the removable case 71, when this latter is associated therewith.

When the electromagnet is of the polarized type, and when accordingly it is not necessary to cause a current to flow permanently in its coil for keeping the armature in the work position which a certain pulse communicated thereto, a mechanical means connected to this armature may cause the appearance of a flap on the front face and for this position.

When the electromagnet is associated with an engagement device such as 90, pusher 85 will be connected to this mechanical means because the armature of the associated electromagnet finds itself again in this case in the same rest position after the passage of each pulse, whereas the position of the pusher is representative of that of the mobile lever.

In the different embodiments which have just been described, the repulsion forces appear between a fixed conductor 15 which supports the fixed contact 16 and a pivoting conductor 73 which supports the mobile contact 7 of a repulsion switch 8. The limiting effect of such a switch may be improved by the above arrangements.

Figure 12:
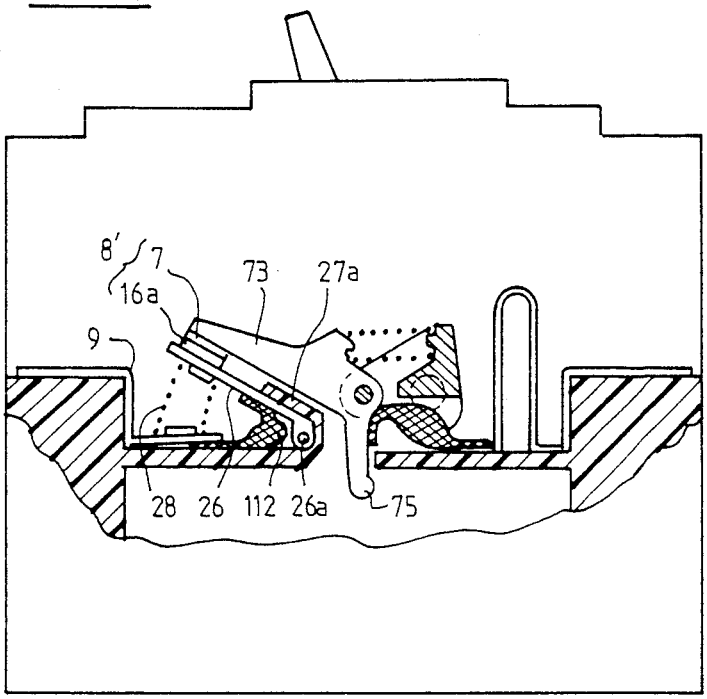
FIG. 12 shows how, in an apparatus of the kind shown in FIGS. 9 and 10, a repulsion switch of the type shown in FIG. 2 may be used.

The construction of an improved repulsion switch 8', whose principle is given schematically in FIG. 2, is shown in greater detail in FIG. 12 where it can be seen that the fixed contact 16 of the preceding switches has become a retractable or pseudo fixed contact **16*a*; the conductor or lever 26 which supports it is pivotably mounted in the body on a pivot 26*a* and it is applied by a spring 28 towards the mobile contact 7. An insulating wall 27*a* of the body represents the stop 27 against which the lever is applied under the effect of the spring 28 when switch 8' is opened and provides efficient insulation with lever 73 for preventing restriking of the arc during opening of the switch. A braided wire or other flexible conductor 112 electrically connects this lever 26 to the circuit 9 of the switch. As in this latter case, the angular travel distances which are effected in opposite directions by levers 73 and 26** are added together for causing the limitation phenomenon, this latter is then more efficient.

Taking into account this addition, the ratio K which was mentioned above may be applied here to the apparent overall elasticity.

What is claimed is:

1. A remote-controlled circuit breaker apparatus, more particularly a multiphase circuit breaker comprising:

(i) a switch placed in an arc extinction chamber, said switch having:

a first contact mounted on a first conducting support;

a second contact mounted on a second conducting support mobile with respect to the first conducting support and having an abutment surface, a resilient means coupled to said second conducting support said second contact being movable between at least an open position and a closed position, wherein it is applied against said first contact and said second conducting support is facing said first conducting support and extends substantially parallel thereto so as to be subjected to electrodynamic forces caused by short circuit currents flowing through said switch;

(ii) a quick trip mechanism which may be set and released by means of a local manual member, said mechanism, when released, acting on said second conducting support through said resilient means for causing said second contact to pass from the closed position to the open position;

(iii) detector means which react to overcurrents by tripping said mechanism and therefor causing said second contact to pass from the closed position to the open position;

(iv) a remote controlled electromagnet independent from the quick trip mechanism;

(v) coupling means which comprise a mobile abutment element actuated by the electromagnet and cooperating with the said abutment surface for effecting a controlled movement of the second conducting support between said closed position and said open position;

(vi) said resilient means acting on said second conducting support to cause the contacts to be applied against each other under a contact pressure when said quick trip mechanism is in a set position and to allow, in this set position, said controlled movement and a relative opening movement of the contacts under the effect of said electrodynamic forces which causes a limitation of said short circuit currents.

2. The remote controlled circuit breaker apparatus as claimed in claim 1, wherein the second conducting support is a pivoting lever having an extension provided with said abutment surface which is placed in the vicinity of the said abutment element, without being connected thereto.

3. The remote controlled circuit breaker apparatus as claimed in claim 1, wherein said first conducting support comprises a pivoting lever which is held in a rest position by a resilient return force of a spring and by a stop when said switch does not have short circuit currents passing therethrough, and which may move away from this position under the effect of the repulsion forces appearing between said first and said second conducting supports.

4. The circuit breaker apparatus as claimed in claim 1, wherein said electromagnet is returned to a rest position by a spring.

5. The circuit breaker apparatus as claimed in claim 1, wherein said electromagnet is polarized by at least one permanent magnet and is held in a work position by the flux of this magnet.

6. The circuit breaker apparatus as claimed in claim 2, wherein said electromagnet is controlled by current impulses and a mechanical engagement device is associated with said abutment element, said device having rest and work positions and passing successively from one of these positions to the other whenever said electromagnet receives a current impulse, the passage of the device to the work position causing the second contact to move in its open position.

7. The circuit breaker apparatus as claimed in claim 1, wherein said remote control electromagnet is disposed in a removable case or plate which is situated between a securing surface and a body containing said switch and said quick trip mechanism, said apparatus further comprising closure means adapted to close a region common to the body and to the removable case when this latter is not connected thereto.

8. A circuit breaker according to claim 1, wherein said first contact is a fixed contact which is mounted on a fixed conducting support.

9. A circuit breaker according to claim 1, wherein said coupling means comprises means for establishing an electric insulation between said second conducting support and said electromagnet.

10. A remote controlled circuit breaker apparatus, more particularly a multiphase circuit breaker comprising:

(i) a switch place in an arc extinction chamber, said switch having:

a first contact mounted on a first conducting support.

a second contact mounted on a second conducting support mobile with respect to the first conducting support and provided with a pusher, and a resilient means, said second contact being movable between at least an open position and a closed position, wherein it is applied against said first contact and said second conducting support is facing said first conducting support and extends substantially parallel thereto so as to be subjected to electrodynamic forces caused by short circuit currents flowing through said switch;

(ii) a quick trip mechanism which may be set and released by means of a local manual member, said mechanism, when set acting on said second conducting support for causing said second contact to pass from the open position to the closed position and when released, acting on said second conducting support through said resilient means for causing said second contact to pass from the closed position to the open position;

(iii) detector means which react to overcurrents by tripping said mechanism and therefor causing said second contact to pass from the closed position to the open position;

(iv) a remote controlled electromagnet independent from the quick trip mechanism, said electromagnet having a mobile armature coupled to a transmission piece provided with an abutment surface which bears on said pusher, only for causing controlled opening movements of the second contact under the action of the electromagnet, said resilient means acting on said second conducting support to cause the contacts to be applied against each other under a contact pressure when said quick trip mechanism is in a set position and to allow, in this set position, said controlled movement and a relative opening movement of the contacts under the effects of said electrodynamic forces which causes a limitation of said short circuit currents.

11. The circuit breaking apparatus as claimed in claim 10 wherein said second conducting support is a pivoting lever having a first pivoting axis and said pusher is actuated by a rotary transmission piece having a second pivoting axis which extends parallel to the first pivoting axis.

* * * * *